US008298048B2

(12) United States Patent
Sung

(10) Patent No.: US 8,298,048 B2
(45) Date of Patent: Oct. 30, 2012

(54) CMP PAD DRESSER WITH ORIENTED PARTICLES AND ASSOCIATED METHODS

(76) Inventor: Chien-Min Sung, Tansui (TW)

( * ) Notice: Subject to any disclaimer, the term of this patent is extended or adjusted under 35 U.S.C. 154(b) by 0 days.

(21) Appl. No.: 13/281,215

(22) Filed: Oct. 25, 2011

(65) Prior Publication Data

US 2012/0100787 A1 Apr. 26, 2012

Related U.S. Application Data

(63) Continuation of application No. 12/355,656, filed on Jan. 16, 2009, now Pat. No. 8,043,145, which is a continuation of application No. 11/238,819, filed on Sep. 28, 2005, now Pat. No. 7,491,116.

(60) Provisional application No. 60/614,596, filed on Sep. 29, 2004.

(51) Int. Cl.
*B24B 19/00* (2006.01)
*B24B 1/00* (2006.01)

(52) U.S. Cl. ..... 451/443; 51/293; 51/307; 451/56; 451/72

(58) Field of Classification Search ..... 51/295, 51/297, 307, 308, 309, 293; 156/230, 276, 156/279; 427/272, 282, 287; 451/21, 56, 451/72, 259, 443, 539, 548
See application file for complete search history.

(56) References Cited

U.S. PATENT DOCUMENTS

| | | | | |
|---|---|---|---|---|
| 2,817,885 | A | | 12/1957 | Long |
| 2,999,275 | A | | 9/1961 | Blume, Jr. |
| 3,877,891 | A | | 4/1975 | Inoue |
| 4,425,315 | A | | 1/1984 | Tsuji et al. |
| 4,680,199 | A | | 7/1987 | Vontell et al. |
| 4,916,869 | A | | 4/1990 | Oliver |
| 4,925,457 | A | * | 5/1990 | deKok et al. ..... 51/293 |
| 4,968,326 | A | * | 11/1990 | Wiand ..... 51/293 |
| 5,049,165 | A | * | 9/1991 | Tselesin ..... 51/295 |
| 5,203,881 | A | | 4/1993 | Wiand |
| 5,250,084 | A | * | 10/1993 | Lansell et al. ..... 51/293 |
| 5,380,390 | A | | 1/1995 | Tselesin |
| 5,453,106 | A | * | 9/1995 | Roberts ..... 51/307 |
| 5,725,421 | A | | 3/1998 | Goers et al. |
| 5,785,039 | A | | 7/1998 | Kobayashi et al. |
| 5,921,856 | A | * | 7/1999 | Zimmer ..... 451/539 |
| 5,989,405 | A | * | 11/1999 | Murata et al. ..... 205/110 |
| 6,039,641 | A | | 3/2000 | Sung |
| 6,106,382 | A | * | 8/2000 | Sakaguchi ..... 451/443 |
| 6,159,087 | A | * | 12/2000 | Birang et al. ..... 451/526 |
| 6,159,286 | A | * | 12/2000 | Sung ..... 117/79 |
| 6,190,240 | B1 | * | 2/2001 | Kinoshita et al. ..... 451/56 |
| 6,213,856 | B1 | * | 4/2001 | Cho et al. ..... 451/443 |
| 6,286,498 | B1 | | 9/2001 | Sung |

(Continued)

OTHER PUBLICATIONS

Tsai, Ming-Yi et al., "CMP Pad Dressing with Oriented Diamond", Twenty First International VLSI Multilevel Interconnection Conference, Sep. 30-Oct. 2, 2004, pp. 1-5.

*Primary Examiner* — Timothy V Eley

(74) *Attorney, Agent, or Firm* — Thrope North & Western LLP

(57) ABSTRACT

CMP pad dressers with superabrasive particles oriented into an attitude that controls CMP pad performance, and methods associated therewith are disclosed and described. The controlled CMP pad performance may be selected to optimize CMP pad dressing rate and dresser wear.

13 Claims, 1 Drawing Sheet

U.S. PATENT DOCUMENTS 6,325,709 B1 12/2001 Nanda et al.
6,368,198 B1 * 4/2002 Sung et al. ..... 451/443
6,669,745 B2 * 12/2003 Prichard et al. ..... 51/297
6,755,720 B1 * 6/2004 Ishizaki et al. ..... 451/28
6,852,004 B2 * 2/2005 Chu et al. ..... 451/8
6,872,127 B2 * 3/2005 Lin et al. ..... 451/56
6,884,155 B2 * 4/2005 Sung et al. ..... 451/443
6,945,857 B1 * 9/2005 Doan et al. ..... 451/56
6,958,005 B1 * 10/2005 Charatan ..... 451/56
7,491,116 B2 2/2009 Sung

* cited by examiner

CMP PAD DRESSER WITH ORIENTED PARTICLES AND ASSOCIATED METHODS

RELATED APPLICATIONS

This application is a continuation of U.S. patent application Ser. No. 12/355,656, filed on Jan. 16, 2009, now U.S. Pat. No. 8,043,145 which is a continuation of U.S. patent application Ser. No. 11/238,819, filed on Sep. 28, 2005, now U.S. Pat. No. 7,491,116 which claims the benefit of U.S. Provisional Patent Application No. 60/614,596 filed Sep. 29, 2004, each of which are incorporated herein by reference.

FIELD OF THE INVENTION

The present invention relates generally to devices and methods for use in connection with dressing or conditioning a chemical mechanical polishing (CMP) pad. Accordingly, the present invention involves the chemical and material science fields.

BACKGROUND OF THE INVENTION

Chemical mechanical process (CMP) has become a widely used technique for polishing certain work pieces. Particularly, the computer manufacturing industry has begun to rely heavily on CMP processes for polishing wafers of ceramics, silicon, glass, quartz, metals, and mixtures thereof for use in semiconductor fabrication. Such polishing processes generally entail applying the wafer against a rotating pad made from a durable organic substance such as polyurethane. To the pad is added a chemical slurry containing a chemical solution capable of breaking down the wafer substance and an amount of abrasive particles which act to physically erode the wafer surface. The slurry is continually added to the spinning CMP pad, and the dual chemical and mechanical forces exerted on the wafer cause it to be polished in a desired manner.

Of particular importance to the quality of polishing achieved, is the distribution of the abrasive particles throughout the pad. The top of the pad holds the particles, usually by a mechanism such as fibers, or small pores, which provide a friction force sufficient to prevent the particles from being thrown off of the pad due to the centrifugal force exerted by the pad's spinning motion. Therefore, it is important to keep the top of the pad as flexible as possible, and to keep the fibers as erect as possible, or to assure that there are an abundance of openings and pores available to receive new abrasive particles.

A problem with maintaining the top of the pad is caused by an accumulation of polishing debris coming from the work piece, abrasive slurry, and dressing disk. This accumulation causes a "glazing" or hardening of the top of the pad that mats the fibers down, thus making the pad less able to hold the abrasive particles of the slurry, and thus significantly decreases the pad's overall polishing performance. Further, with many pads the pores used to hold the slurry become clogged, and the overall asperity of the pad's polishing surface becomes depressed and matted. Therefore, attempts have been made to revive the top of the pad by "combing" or "cutting" it with various devices. This process has come to be known as "dressing" or "conditioning" the CMP pad. Many types of devices and processes have been used for this purpose. One such device is a disk with a plurality of super hard crystalline particles, such as diamond particles attached to a surface, or substrate thereof.

Yet another disadvantage with modern CMP pad dressers is reduced life of the pad conditioner and CMP pad. As noted, abrasive particles and CMP pads can wear out prematurely when the particles cut too deeply into the pad and consume the pad unnecessarily. Such premature wear reduces the ability of the CMP pad dresser to effectively polish the work piece. When functioning optimally, the abrasive particles act to refurbish the asperities in the CMP pad, and thus create an optimal polishing environment.

The rate at which a CMP pad is dressed may affect the surface roughness of the pad, which in turn may determine the amount of slurry held on the surface and thus affect polishing rate. In general, the polishing rate of the wafer is proportional to the dressing rate. However, if he dressing rate is excessive, the pad surface may become overly rough, and thus decrease the uniformity of the polished wafer. As such, optimizing the dressing rate may improve polishing rate without adversely affecting the quality of the wafer.

In view of the foregoing, it is desirable to obtain CMP pad dressers and methods configured to control dresser performance in order to achieve optimal dressing results, with maximized efficiency and lifespan for various applications.

SUMMARY OF THE INVENTION

Accordingly, in one aspect, the present invention provides methods and CMP pad dresser configurations for controlling CMP pad dresser performance. In one such method, a CMP pad dresser is provided which employs a plurality of superabrasive particles each coupled to a substrate member and oriented into an attitude that provides anticipated performance characteristic as part of the CMP pad dresser fabrication performance. In other aspects, the performance characteristic of the present invention can optimize dressing rate and dresser wear. Furthermore, in another aspect of the present invention, the performance characteristic can be an optimized balance of dressing rate and dresser wear. It has been discovered that orienting the superabrasive particles in a predetermined pattern or configuration can enhance and optimize the dressing rate and dresser wear. More particularly, a method that employs superabrasive particles to have a predetermined attitude can control the dresser performance characteristics.

In accordance with one aspect of the present invention, the method involves providing a substrate, and then coupling a plurality of superabrasive particles to the substrate such that the superabrasive particles are oriented in an attitude that provides optimal dresser characteristics. The coupled superabrasive particles can be substantially configured in an attitude having an apex portion oriented towards a pad to be dressed. Further, the superabrasive particles can be configured in an attitude having an edge portion or face portion oriented towards a pad to be dressed. Such varied orientation can alter the dresser performance characteristics to obtain a dresser that has an optimized dressing rate and dresser wear.

In an another aspect, superabrasive particles in a central location can be oriented in an attitude having an apex portion oriented toward a pad to be dressed and superabrasive particles in a peripheral location can be disposed on the substrate or surface in an attitude having either a face or an edge portion oriented toward a pad to be dressed. Varied orientations can create various asperity patterns in the CMP pad. Such patterns can provide variability in the dresser performance by providing asperities that increase the wafer polishing rate while reducing the particle wear. For example, in one aspect, the dresser rate and dresser wear can be balanced by configuring the attitude of centrally located particles to be an apex, the attitude of the peripherally located particles to be a face and any particles therebetween to have an attitude of an edge oriented towards a pad to be dressed.

In yet another aspect of the present invention, a method for optimizing dresser performance may include providing a CMP pad dresser having a plurality of superabrasive particles centrally located which are of a lower quality than peripherally located superabrasive particles. The lower quality can be a number of characteristics such as, lower internal quality, lower shape quality, etc. It has been found that particles of lower shape quality, such as irregular shapes, can dress a CMP pad more aggressively than those of higher shape quality, however, the lower quality particles have a slower pad dressing rate because they are prone to chipping and breaking. On the other hand, the higher shape qualities, such as octahedral or cubo-octahedral, dress less aggressively, however, have more durability, allowing for a higher dressing rate. The durability also helps shield the inner or central particles from excessive wear. Therefore, placing a lower quality particle in the central location of the pad dresser and a higher quality particle on the peripheral, can result in a balanced dressing rate and dresser wear.

In addition to the above-recited methods of use, the present invention also includes methods for producing a CMP pad dresser that optimizes dresser performance by orienting the superabrasive particles in a predetermined pattern. Generally speaking, such a method may include providing a substrate, selecting an attitude for superabrasive particles that provides an anticipated performance characteristic, orienting the superabrasive particles in an attitude in relation to the substrate, and bonding the superabrasive particles to the substrate in the selected attitude.

Using the methods described above, CMP pad dressers exhibiting considerable advantages may be created. For example, the CMP pad dressing performance can be controlled to optimize CMP pad dressing rate and dresser wear. Such optimized performance can create a balance between dresser wear and dressing rate, thus lengthening the service life of the dresser, while maximizing the rate at which the dresser grooms the pad.

The above-recited features and advantages of the present invention will become apparent from a consideration of the following detailed description presented in connection with the accompanying drawings.

DETAILED DESCRIPTION OF THE INVENTION

Figure 1:
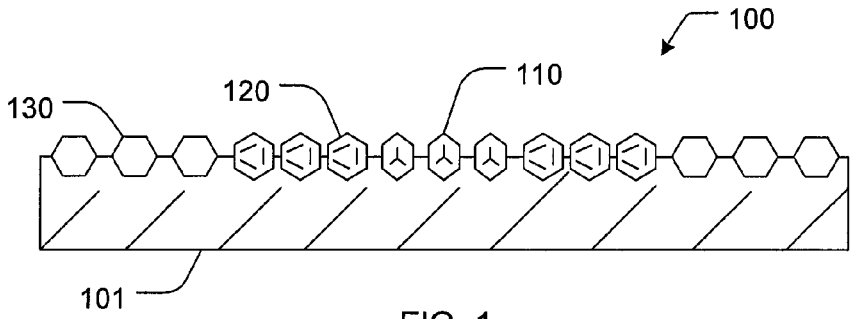
FIG. 1 is a side view of a CMP pad dresser in accordance with one embodiment of the present invention.

Before the present CMP pad dresser and accompanying methods of use and manufacture are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and, "the" include plural referents unless the context clearly dictates otherwise. Thus, for example, reference to an "abrasive particle" or a "grit" includes reference to one or more of such abrasive particles or grits.

Definitions

In describing and claiming the present invention, the following terminology will be used in accordance with the definitions set forth below.

As used herein, "superabrasive particles" and "superabrasive grit" or similar phrases may be used interchangeably, and refer to any natural or synthetic super hard crystalline, or polycrystalline substance, or mixture of substances and include but are not limited to diamond, polycrystalline diamond (PCD), cubic boron nitride (cBN), and polycrystalline cubic boron nitride (PcBN). Further, the terms "abrasive particle," "grit," "diamond," "polycrystalline diamond (PCD)," "cubic boron nitride," and "polycrystalline cubic boron nitride, (PcBN)," may be used interchangeably.

As used herein, "superhard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "substrate" means a portion of a CMP dresser which supports abrasive particles, and to which abrasive particles may be affixed. Substrates useful in the present invention may be any shape, thickness, or material, that is capable of supporting abrasive particles in a manner that is sufficient provide a tool useful for its intended purpose. Substrates may be of a solid material, a powdered material that becomes solid when processed, or a flexible material. Examples of typical substrate materials include without limitation, metals, metal alloys, ceramics, and mixtures thereof. Further the substrate may include brazing alloy material.

As used herein, "leading edge" means the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, "sharp portion" means any narrow portion to which a crystal may come, including but not limited to corners, ridges, edges, obelisks, and other protrusions.

As used herein, "centrally located particle," "particle in a central location" and the like mean any particle of a dresser that is located in an area of a dresser that originates at a center point of the dresser and extends outwardly towards the dresser's edge for up to about 90% of the radius of the dresser. In some aspects, the area may extend outwardly from about 20% to about 90% of the radius. In other aspects, the area may extend out to about 50% of the radius. In yet another aspect, the area may extend out to about 33% of the radius of a dresser.

As used herein, "peripherally located," "particles in a peripheral location" and the like, mean any particle of a dresser that is located in an area that originates at the leading edge or outer rim of a dresser and extends inwardly towards the center for up to about 90% of the radius of the dresser. In some aspects, the area may extend inwardly from about 20% to 90% of the radius. In other aspects, the area may extend in to about 50% of the radius. In yet another aspect, the area may extend in to about 33% of the radius of a dresser (i.e. 66% away from the center).

As used herein, "working end" refers to an end of a particle which is oriented towards the CMP pad and during a dressing operation makes contact with the pad. Most often the working end of a particle will be distal from a substrate to which the particle is attached.

As used herein, "quality" means a degree or grade of excellence. Each characteristic or property of a superabrasive particle such as internal crystalline perfection, shape, etc. may be ranked in order to determine the quality of the particle. A number of established quality scales exist in the area of diamonds and other superabrasives, such as the Gemological Institute of America (GIA) Diamond Grading Report or the GIA Scale, which will be well recognized by those of ordinary skill in the art.

As used herein, "amorphous braze" refers to a homogenous braze composition having a non-crystalline structure. Such alloys contain substantially no eutectic phases that melt incongruently when heated. Although precise alloy composition is difficult to ensure, the amorphous brazing alloy as used herein should exhibit a substantially congruent melting behavior over a narrow temperature range.

As used herein, "alloy" refers to a solid or liquid mixture of a metal with a second material, said second material may be a non-metal, such as carbon, a metal, or an alloy which enhances or improves the properties of the metal.

As used herein, "metal brazing alloy," "brazing alloy," "braze alloy," "braze material," and "braze," may be used interchangeably, and refer to a metal alloy which is capable of chemically bonding to superabrasive particles, and to a matrix support material, or substrate, so as to substantially bind the two together. The particular braze alloy components and compositions disclosed herein are not limited to the particular embodiment disclosed in conjunction therewith, but may be used in any of the embodiments of the present invention disclosed herein.

As used herein, the process of "brazing" is intended to refer to the creation of chemical bonds between the atoms of the superabrasive particles and the braze material. Further, "chemical bond" means a covalent bond, such as a carbide, nitride, or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond. Therefore, brazing of a superabrasive segment to a tool body does not require the presence of a carbide, nitride, or boride former.

As used herein, in conjunction with the brazing process, "directly" is intended to identify the formation of a chemical bond between the superabrasive particles and the identified material using a single brazing metal or alloy as the bonding medium.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, and silicon carbides, tungsten carbides, etc.

As used herein, "metallic" means any type of metal, metal alloy, or mixture thereof, and specifically includes but is not limited to steel, iron, and stainless steel.

As used herein, "grid" means a pattern of lines forming multiple squares.

As used herein with respect to distances and sizes, "uniform" refers to dimensions that differ by less than about 75 total micrometers.

As used herein, "attitude" means the position or arrangement of a superabrasive particle in relation to a defined surface, such as a substrate to which it is attached, or a CMP pad to which it is to be applied during a work operation. For example, a superabrasive particle can have an attitude that provides a specific portion of the particle in orientation toward a CMP pad.

As used herein, "working end" refers to an end of a particle which is oriented towards the CMP pad and during a dressing operation makes contact with the pad. Most often the working end of a particle will be distal from a substrate to which the particle is attached.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

The Invention

The present invention provides devices and methods for optimizing the dressing performance of a chemical mechanical polishing (CMP) pad dresser that employs superabrasive particles. By orienting such particles into certain attitudes, it has been discovered that the dressing rate and dresser wear can be controlled. In one aspect, performance is optimized through configurations that improve the longevity of the superabrasive particles on the dresser and the useful service life of the CMP pad, while maintaining sufficient CMP pad dressing rates.

FIG. 1 shows a CMP pad dresser in accordance with one embodiment of the present invention. The CMP pad conditioner 100 includes a substantially flat substrate 101, having a plurality of superabrasive particles 110, 120, and 130 coupled thereto. Each of the superabrasive particles is oriented in a particular attitude that provides a desired working portion such as an apex, an edge, or a face that contacts the CMP pad during a dressing operation.

The optimization of wear of the dresser and the dressing rate of a CMP pad is dependent on many factors, among them the orientation of the superabrasive particles. Various types of superabrasive particles may be utilized in various aspects of the present invention. For example, such materials may include without limitation, diamond, polycrystalline diamond (PCD), cubic boron nitride (cBN) and polycrystalline cubic born nitride (PcBN). In some aspects, the superabrasive particles may include diamond. In one aspect, the diamond superabrasive particles may exhibit a combination of cubic and octahedral faces. Further, the superabrasive particles can be of a predetermined shape. For example, the superabrasive particles can be a euhedral shape or either a octahedral or cubo-octahedral shape. Though virtually any size of superabrasive particle would be considered to be within the scope of the present invention, in one aspect the particles may range in size from about 100 to 350 micrometers. Additionally, the superabrasive particles can be oriented in many directions relative to the pad, but there are three major orientations or attitudes that may affect the particle's cutting or grooming behavior. These attitudes a expose either an apex, an edge, or a face of the superabrasive particle towards a CMP pad being dressed.

Orienting the superabrasive particles in a specific attitude in relation to the CMP pad to be dressed creates different asperities in the pad surface, thus altering the performance of the CMP pad. Different asperities retain slurry in different manners and thus polish the silicon chip wafer differently according to asperity depth, width, density, etc. The superabrasive particles of a CMP pad dresser can be oriented according to the desired polishing characteristics of the CMP pad. For example, if the superabrasive particles predominantly have an apex oriented towards the CMP pad, the asperities of the pad will be narrow and deep. The advantage of narrow and deep asperities are that the pad can better retain the polishing slurry, and thus the polishing rate of the wafer increases. However, the increased polishing rate may also increase the wear rate of the superabrasive particles. As such, wear rate may vary considerably depending on the attitude of the superabrasive particles, and therefore, the orientation of each superabrasive particle may be considered when designing a device with desired performance characteristics. Generally speaking, superabrasive particle attitudes that provide higher dressing rates (i.e. deeper penetration into a pad) also wear particles out at a higher rate.

In contrast, if the superabrasive particles are oriented with a face towards the pad, the resulting asperities may polish at a lower rate. The face of the particle is generally thought to be more durable, but does not typically cut deep and narrow asperities in the pad, but rather asperities that are shallow and broad. Therefore the face portion of a particle will dress a CMP pad at a reduced rate compared to the apex portion of a particle, but the superabrasive particle will wear at a much lower rate.

The edge portions of a superabrasive particle have dressing and wear characteristics that are between those of the face and apex portions. It has been thought that if the edge portion is utilized to dress a CMP pad, the asperities are not as deep or narrow as those dressed with an apex portion, but may provide asperities having desirable intermediate characteristics. Further, the edge portion of the particle does not wear at such a high rate as that of an apex. Hence, a CMP pad dresser utilizing all or a portion of superabrasive particles having exposed edge portions may provide a number of advantages.

Referring again to FIG. 1, the plurality of superabrasive particles are shown having various attitudes with respect to the substrate 101. Such attitudes may include an apex oriented toward a pad to be dressed as with centrally located particles 110, and edge oriented toward a pad to be dressed as with particles 120, or a face oriented toward the pad to be dressed as with peripherally located particles 130. Such an embodiment of the present invention may provide both dressing rate and dresser wear advantages. The arrangement provides centrally located particles that have aggressive dressing characteristics, while the particles located on the periphery may be more durable and shield the inner and central particles from excessive wear.

Figure 2:
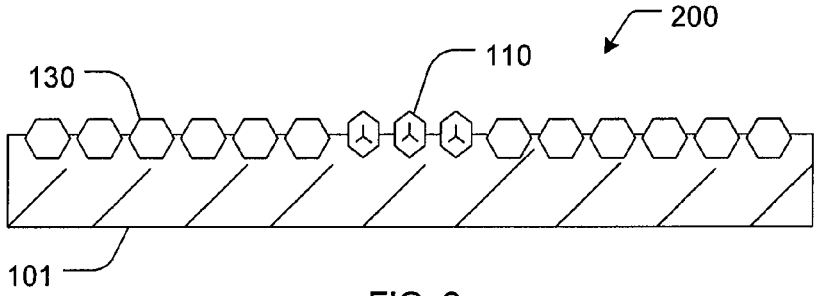
FIG. 2 is a side view of a CMP pad dresser in accordance with one embodiment of the present invention.

In another aspect of the present invention, FIG. 2 shows a CMP pad dresser 200 having a plurality of superabrasive particles disposed along a substrate 101, where the centrally located superabrasive particles 110 are disposed in an attitude with an apex oriented toward a pad to be dressed, and the remaining superabrasive particles 130 are disposed in an attitude with a face oriented toward a pad to be dressed.

Figure 3:
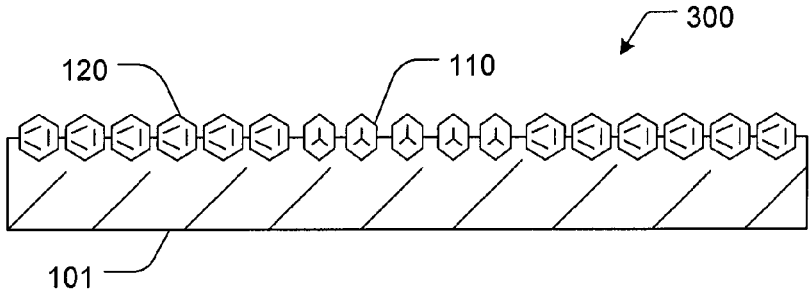
FIG. 3 is a side view of a CMP pad dresser in accordance with one embodiment of the present invention.

FIG. 3 shows yet another embodiment of the present invention. In this embodiment, a CMP pad dresser 300 is shown having a plurality of superabrasive particles disposed along a substrate 101, where the superabrasive particles that are centrally located are disposed in an attitude with an apex oriented toward a pad to be dressed 110, and the remaining superabrasive particles have an attitude of an edge oriented toward a pad to be dressed 120.

Figure 4:
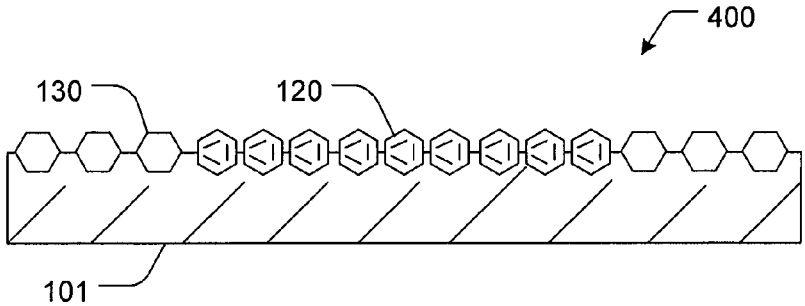
FIG. 4 is a side view of a CMP pad dresser in accordance with one embodiment of the present invention.

In still another aspect of the present invention, as depicted in FIG. 4, a CMP pad dresser 400 is shown, having a plurality of abrasive particles disposed along a substrate 101, where centrally located superabrasive particles are oriented in an attitude having an edge portion oriented toward a CMP pad to be dressed 120, and peripherally located superabrasive particles being oriented in an attitude having a face orient towards the CMP pad 130. In other aspects, substantially all of the superabrasive particles may be oriented in an attitude having an apex oriented towards the CMP pad (not shown), or substantially all superabrasive particles may be oriented in an attitude having an edge oriented toward the CMP pad (not shown). Various aspects are also contemplated wherein substantially all of the superabrasive particles may be oriented in an attitude having a face oriented toward the CMP pad (not shown).

In an alternative embodiment (not illustrated), the present invention discloses a method for optimizing CMP pad dressing performance by utilizing abrasive particles of different qualities. The qualities referred to can include external superabrasive particle shapes and internal superabrasive particle flaws or defects. Irregular shaped (euhedral shaped) particles often contain sharp portions or apexes which enable aggressive dressing. These sharp portions cut deep asperities in the pad that tend to increase polishing rate. However, because the irregular particles can be of a lower internal quality, they are prone to chipping that may cause wafer scratching. In contrast, abrasive particles exhibiting octahedral or cubo-octahedral shapes provide a higher shape quality and/or higher durability quality. The higher quality particles lacks sharp portions as compared to irregular particles, and are thus less prone to chipping, breaking, and subsequently scratching the wafer.

The present invention further provides a method to utilize abrasive particles having different qualities. For example, the present invention discloses a CMP pad dresser having a plurality of superabrasive particles coupled to a substrate, where the centrally located superabrasive particles are of a lower quality than the peripherally located superabrasive particles.

In other words, the peripherally located superabrasive particles are of a higher quality. Lower quality can include a lower internal quality, a lower shape quality, etc. A lower internal quality can include the number of flaws and/or inclusions in a superabrasive particle. A lower shape quality can include a superabrasive particle having an irregular shape, while a higher shape quality can include a superabrasive particle having an octahedral or cubo-octahedral shape. The present invention presents an arrangement of superabrasive particles where the higher quality superabrasive particles are located near the periphery of the dresser, which helps to protect and shield the centrally located lower quality particles from chipping and breaking. The present configuration can control CMP pad dresser performance, thus optimizing dresser wear and dressing rate.

The present invention additionally encompasses methods for manufacturing a CMP pad dresser as recited herein. In one aspect, such a method may include providing a substrate, selecting an attitude for superabrasive particles that provides an anticipated performance characteristic, orienting the superabrasive particles into the selected attitude in relation to the substrate, and bonding the abrasive particles to the substrate in the selected attitude. The substrate of the various aspects of the present invention can be made of a metallic, a ceramic, a powder, a metallic powder, or a flexible material. In a one embodiment the substrate can be stainless steel.

Particle placement and methods and materials for affixing superabrasive particles to a substrate in predetermined configurations, such as grid, may be found in U.S. Pat. Nos. 6,039,641, 6,286,498, 6,368,198, and Applicant's copending U.S. patent application Ser. No. 10/109,531 filed Mar. 27, 2002, each of which is incorporated herein by reference in their entirety.

Finally, the superabrasive particles may be coupled to a substrate that is made of metallic powders. Metallic powders may be selected from a number of materials known for forming a substrate. Further such metallic powder may contain brazing alloys to facilitate the brazing of the superabrasive particles. In a preprocess step, in forming a substrate, the superabrasive particles may be disposed into the metallic powder prior to solidification or consolidation. During the brazing or consolidation step, the abrasive particles are chemically bonded to the substrate, providing a durable CMP pad dresser which may be less vulnerable to particle chipping and dislodging. In addition, to the brazing method previously described, the particles may be affixed to a substrate through electroplating methods.

In various aspects of the present invention, orienting the superabrasive particles in a particular attitude can be accomplished by using magnetic fields or vacuums. Placement and orientation of superabrasive particles through magnetic methods are discussed in U.S. Pat. Nos. 4,916,869 and 5,203,881, which are incorporated herein by reference. An example of a suitable vacuum method may be found in U.S. Pat. No. 4,680,199, which is incorporated herein by reference. Essentially, a vacuum having a chuck designed to retrieve abrasive particles through vacuum means and then dispose the abrasive particles on a substrate is discussed. The vacuum chuck tubes in the chuck can be configured with openings that orient the superabrasive particles into selected attitudes though a mechanical matching process. Once the superabrasive particles have been properly oriented, the vacuum disposes the superabrasive particles on the substrate to which they will be fixed without disturbing or altering the attitude of the particles. The result is a CMP pad dresser with oriented particles configured to optimize dresser performance for a desired aspect.

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

The invention claimed is:

1. A method for controlling CMP pad dresser performance in a CMP pad dresser as part of the pad dresser fabrication process, the pad dresser employing a plurality of superabrasive particles comprising:

orienting the superabrasive particles into an attitude that provides an anticipated performance characteristic, wherein all superabrasive particles in a central location on the dresser are disposed in an attitude with an edge oriented toward a pad to be dressed, and all remaining superabrasive particles are disposed in an attitude whereby an edge is not oriented toward the pad, and wherein the attitudes of the superabrasive particles in the central location on the dresser are different from the attitudes of the remaining superabrasive particles.

2. The method of claim 1, wherein the performance characteristic is an optimal pad dressing rate.

3. The method of claim 1, wherein the performance characteristic is optimal pad dresser wear.

4. The method of claim 1, wherein the performance characteristic is an optimized balance of dressing rate and dresser wear.

5. The method of claim 1, wherein the superabrasive particles include members selected from a group consisting of: diamond, polycrystalline diamond (PCD), cubic boron nitride (cBN), and polycrystalline cubic boron nitride (PCBN).

6. The method of claim 1, wherein the superabrasive particles are attached to a substrate selected from the group consisting essentially of metallic materials, flexible materials, ceramic materials and mixtures thereof.

7. The method of claim 1, wherein superabrasive particles not in a central location on the dresser are disposed in an attitude with a face oriented toward a pad to be dressed.

8. The method of claim 1, wherein superabrasive particles not in a central location on the dresser are disposed in an attitude with an apex oriented toward a pad to be dressed.

9. A chemical mechanical polishing (CMP) pad dresser comprising:

a substrate; and a plurality of superabrasive particles attached to the substrate, said particles being configured in an attitude that controls CMP pad dresser performance, wherein all superabrasive particles that are centrally located are disposed in an attitude with an edge oriented toward a pad to be dressed, and all remaining superabrasive particles are disposed in an attitude whereby an edge is not oriented toward the pad, and wherein the attitudes of the superabrasive particles in the central location on the dresser are different from the attitudes of the remaining superabrasive particles.

10. The CMP pad dresser of claim 9, wherein superabrasive particles not in a central location on the dresser are disposed in an attitude with a face oriented toward a pad to be dressed.

11. The CMP pad dresser of claim 9, wherein superabrasive particles not in a central location on the dresser are disposed in an attitude with an apex oriented toward a pad to be dressed.

12. The CMP pad dresser of claim 9, wherein said superabrasive particles have a size from about 100 to 350 micrometers.

13. A method for manufacturing a CMP pad dresser as recited in claim 9, comprising the steps of:

providing a substrate;

selecting an attitude for superabrasive particles that provides an anticipated performance characteristic;

orienting the superabrasive particles into the selected attitude in relation to the substrate; and bonding the abrasive particles to the substrate in the selected attitude.

* * * * *